US012060775B2

(12) United States Patent
Strange

(10) Patent No.: US 12,060,775 B2
(45) Date of Patent: Aug. 13, 2024

(54) LIQUID HAMMER DRILL

(71) Applicant: Warren Ross Strange, Claremont (AU)

(72) Inventor: Warren Ross Strange, Claremont (AU)

(73) Assignee: Warren Ross Strange, Claremont (AU)

( * ) Notice: Subject to any disclaimer, the term of this patent is extended or adjusted under 35 U.S.C. 154(b) by 0 days.

(21) Appl. No.: 17/765,768

(22) PCT Filed: Oct. 2, 2020

(86) PCT No.: PCT/AU2020/051060

§ 371 (c)(1),
(2) Date: Mar. 31, 2022

(87) PCT Pub. No.: WO2021/062483

PCT Pub. Date: Apr. 8, 2021

(65) Prior Publication Data

US 2022/0372820 A1 Nov. 24, 2022

(30) Foreign Application Priority Data

Oct. 3, 2019 (AU) ..... 2019903718

(51) Int. Cl.
*E21B 4/14* (2006.01)
*E21B 4/00* (2006.01)

(52) U.S. Cl.
CPC ..... *E21B 4/14* (2013.01); *E21B 4/003* (2013.01)

(58) Field of Classification Search
CPC ..... E21B 4/14
See application file for complete search history.

(56) References Cited

U.S. PATENT DOCUMENTS 4,013,319 A * 3/1977 Wise ..... E21D 9/08 175/96
5,056,606 A * 10/1991 Barthomeuf ..... B25D 9/145 173/208
5,497,839 A * 3/1996 Moir ..... E21B 21/12 175/218
2014/0183800 A1* 7/2014 Stewart ..... E21B 10/46 264/319

* cited by examiner

*Primary Examiner* — Cathleen R Hutchins
*Assistant Examiner* — Ronald R Runyan
(74) *Attorney, Agent, or Firm* — K&L Gates LLP

(57) ABSTRACT

A liquid hammer drill comprising: a housing; a drill bit at a leading end of said housing wherein said drill bit includes a trailing end and a leading end that defines a cutting portion; a piston member located inside said housing and having a trailing end, a leading end and an intermediate portion therebetween, said piston member being capable of movement between a first position and a second position at which it impacts the trailing end of the drill bit; a liquid circuit for delivering a liquid to the piston member to cause the piston member to oscillate between its first and second positions and transfer the liquid outside the housing via a liquid outlet; a sealing member for isolating the trailing end of the drill bit from the liquid circuit wherein, in use, the piston member impacts the trailing end of the drill bit in a liquid free environment.

17 Claims, 2 Drawing Sheets

LIQUID HAMMER DRILL

CROSS-REFERENCE TO RELATED APPLICATIONS

This application is the National Stage filing under 35 U.S.C. 371 of International Application No. PCT/AU2020/051060, filed on Oct. 2, 2020, which claims the benefit of earlier filing date and right of priority to Australian Application No. 2019903718 filed on Oct. 3, 2019, the contents of which are all hereby incorporated by reference herein in their entirety.

FIELD

The present disclosure relates to an improved liquid hammer drill. More particularly the present disclosure relates to a relatively short liquid hammer drill with a number of performance advantages. The present disclosure also relates to a cutter head assembly and to a tunnel boring machine.

BACKGROUND

In the mining industry, large bore shafts, either vertical, angle or horizontal, have been created with the use of percussion tools for many years.

Cluster drills traditionally use air percussion hammers and all of the drill cuttings are blown with air pressure and air volume (CFM) out of the shaft. However, cluster drills with air hammers are very long and require very large air volumes which make them unsuitable for use in tunnel boring machines (TBM). In this regard, the air exhausted from such TBMs would mean that the tunnel behind the TBM while operating would not be accessible.

Water hammer drills have also been in use for many years. However, the requirement for high volumes of water to operate these drills and the difficulties created by the exhausted water make them unsuitable for use as part of a TBM.

The present disclosure seeks to provide a liquid hammer drill that addresses the problems discussed above. At the very least the present disclosure seeks to provide an alternative to current solutions for drills suitable for use in TBMs.

SUMMARY

According to a first aspect, the present disclosure provides a liquid hammer drill configured for insertion into a cutter head of a tunnel boring machine, comprising: (a) a housing; (b) a drill bit disposed at a leading end of the housing, the drill bit including a trailing end and a leading end, the leading end defining a cutting portion; (c) a piston member located inside the housing and having a trailing end and a leading end, the piston member configured to move between a first position and a second position, such that in the second position the leading end of the piston impacts the trailing end of the drill bit; (d) a closed liquid circuit for delivering a liquid to the piston member within the housing to cause the piston member to oscillate between the first and second positions; and (e) a sealing member for isolating the trailing end of the drill bit from the closed liquid circuit such that the piston member impacts the trailing end of the drill bit in a liquid free environment.

Preferably, the liquid hammer drill is relatively short in terms of length. For the purposes of the present disclosure, the term "relatively short" is intended to differentiate the liquid hammer drill from existing hammer drills that tend to be longer. Preferably, the liquid hammer drill has a length of or about 0.8, 0.9, 1, 1.1 or 1.2 m. Even more preferably, the liquid hammer drill has a length of equal to or less than 0.7, 0.8, 0.9 or 1 m.

Preferably, the liquid hammer drill has a width or diameter of about 7 to 75, 10 to 65, 15-50 or 25-40 cm.

Preferably, the ratio of the length of the liquid hammer drill to its width is less than 6, 5.5, 5, 4.5, 4, 3.5, 3, 2.5 or 2. Preferably, the width referred to in the ratio is the largest width of the liquid hammer drill. For example, if the liquid hammer drill has a non-uniform width, the ration is based on the largest width thereof.

Preferably, the liquid is water, salt water, petroleum or liquefied gas.

Preferably, the housing is generally cylindrical.

Preferably, the housing has a circular cross section.

Preferably, the housing defines a tapered leading end.

Preferably, the housing comprises a leading end adapted to receive the drill bit.

Preferably, the housing is adapted to removably receive the drill bit.

Preferably, the housing defines a retention member for the drill bit. Even more preferably, the retention member is a collar member or chuck supported on the housing. Preferably, the retention member includes a first threaded portion adapted to engage with a second threaded portion of the drill bit. Preferably, the collar member is generally ring shaped.

Preferably, the housing defines a port for the liquid inlet circuit and/or the liquid outlet circuit. Even more preferably said port is located at the trailing end of the housing.

Preferably, the drill bit has a relatively low profile.

Preferably, the drill bit is mounted to the outside of the housing. Even more preferably, the drill bit comprises a collar member or shank that extends over an outside portion of the housing when the drill bit is fitted. Preferably, the collar member comprises a threaded portion. It will be understood that by mounting the drill bit on the outside of the housing, the piston member can, relative to prior art hammer drills, be located closer to the trailing end of the drill bit. This, in turn, allows the leading end of the piston member or strike face to be close to the drill face e.g. about 50 to 100 mm from the drill face.

Preferably, the drill bit has a relatively short bit reach. Even more preferably the drill bit has a reach of about 50, 60, 70, 80 or 90 mm.

Preferably, the drill bit comprises a threaded portion for removably attaching the drill bit to the drill.

Preferably, the drill bit defines a strike face for the piston member at its trailing end.

Preferably, the strike face comprises at least one water relief groove. In this regard, if any liquid does ingress to the trailing end of the drill bit then said water relief grooves ensure the piston member still strikes the drill bit in a substantially liquid free environment.

Preferably, the drill bit defines at least one locating member that co-operates with a compatible member to positively locate the drill bit and control its movement when in use. Preferably the locating member and the compatible member are a spline or groove.

Preferably, the cutting face has a substantially circular cross section. Alternatively, the cutting face may have a substantially polygonal cross section such as a square shaped cross section.

Preferably, the cutting face has a relatively low profile or thickness.

Preferably, the cutting face comprises a plurality of buttons. Preferably, the buttons are ovoid shaped.

Preferably, the cutting face defines at least one groove to assist with clearing chips away from the cutting face during use.

Preferably, the drill bit comprises at least one aperture therethrough to allow for the passage of fluid. Preferably, said aperture comprises a vent for air and or liquid that enters the area immediately adjacent to the strike face or trailing end of the drill bit.

Preferably, the piston member comprises a main body portion at its trailing end and its leading end tapers in relative to the main body portion.

Preferably, the intermediate portion defines a shoulder.

Preferably, the main body portion defines a cavity therein for receiving the liquid, during use to move the piston member to its second position.

Preferably, the piston member has a generally circular cross section.

Preferably the piston member, in use, has a travel distance or stroke of about 20, 25, 30 or 35 mm.

Preferably, the liquid circuit is closed.

Preferably, the liquid circuit does not exhaust liquid via the drill bit.

Preferably, the liquid circuit comprises a return portion that delivers the liquid transferred outside the housing via the liquid outlet back into the liquid circuit. In this regard, liquid used in the liquid hammer drill can be circulated and reused.

Preferably, the liquid circuit further comprises a flow controller operable to move between a first and a second position to create pressure differentials that move the piston between its first and second positions. In this regard, the flow controller works in the usual fashion of a conventional water powered down the hole (DTH) hammer. Preferably, the pressure differentials are between the trailing end of the piston member and the liquid outlet.

Preferably, the sealing member is located towards the leading end of the piston member.

Preferably, the sealing member is located between the leading end of the piston member and an adjacent section of the housing.

Preferably, the sealing member is adapted to prevent any liquid from contacting the trailing end of the drill bit such that when the piston member strikes the trailing end of the drill bit it does so in a liquid free environment. However, it will be appreciated that if a small amount of liquid passes the sealing member the liquid hammer drill will still operate as intended. In this regard, for the purposes of the present disclosure the term "liquid free environment" means an environment that is free or substantially free of liquid.

Preferably, the sealing member comprises an O-ring or similar device.

Preferably, the sealing member comprises a plurality of O-rings or similar devices.

According to a second aspect, the present disclosure provides a cutter head assembly for a tunnel boring machine, the cutter head assembly comprising: (a) a cutter head including a cutting face; and (b) a plurality of liquid hammer drills as described herein disclosure configured to locate within the cutter head.

According to a third aspect, the present disclosure provides a tunnel boring machine comprising a cutter head and a plurality of liquid hammer drills disclosure as described herein configured to locate within the cutter head.

Preferably, the tunnel boring machine comprises a cutter head assembly according to a second aspect of the present disclosure.

BRIEF DESCRIPTION OF DRAWINGS

In order to facilitate a better understanding of the present disclosure, preferred embodiments are described herein with reference to the accompanying drawings, in which.

DETAILED DESCRIPTION

The present disclosure will now be described more fully hereinafter with reference to the accompanying drawings, in which preferred embodiments of the disclosure are shown. This disclosure may, however, be embodied in many different forms and should not be construed as limited to the embodiments set forth herein; rather, these embodiments are provided so that this disclosure will be thorough and complete, and will fully convey the scope of the disclosure to those skilled in the art. Like numbers refer to like elements throughout.

Figure 1:
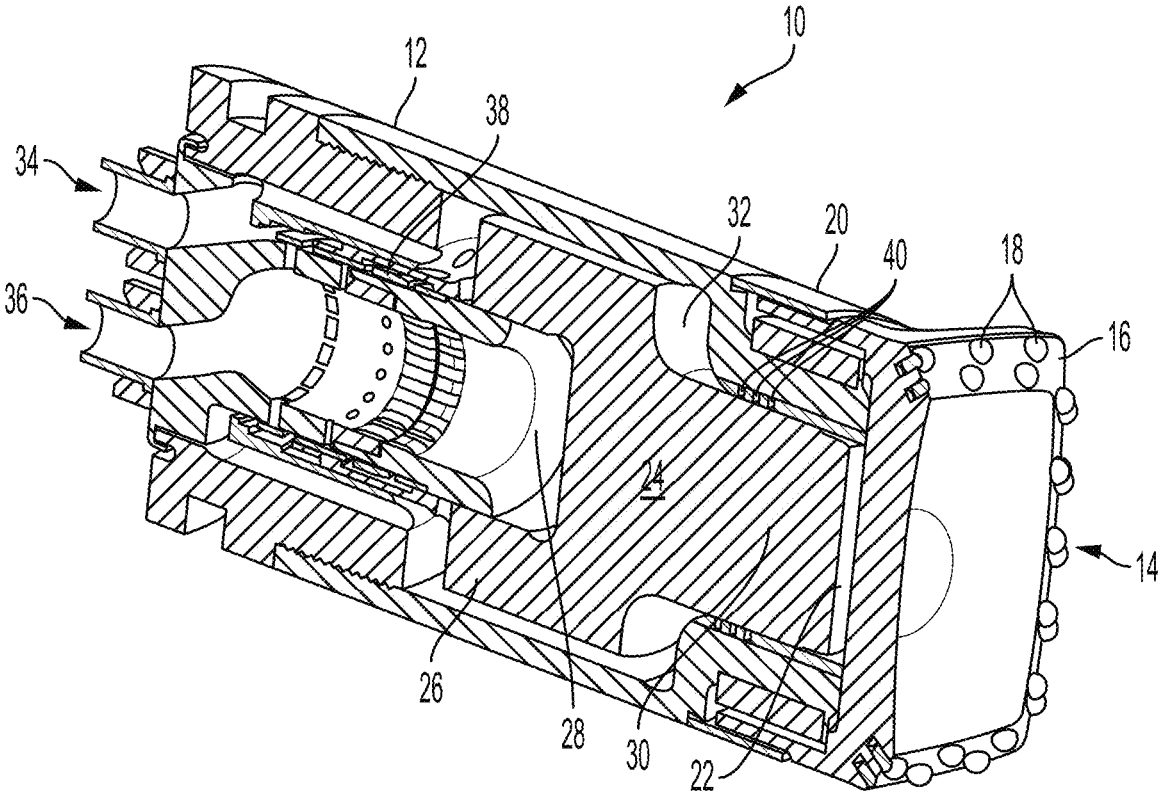
FIG. 1 is perspective view of a liquid hammer drill according to one embodiment of the first aspect of the present disclosure including a cut away to show the internal components of the drill.

A liquid hammer drill according to one embodiment of the first aspect of the present disclosure is depicted in FIG. 1 and generally indicated by the numeral 10.

The drill 10 includes a housing 12 and a drill bit 14 at the leading end of the housing 12. The drill bit 14 includes a leading end defining a cutting portion 16 that includes a plurality of ovoid shaped toughened buttons 18. Whilst not shown in FIG. 1, the cutting portion 16 includes an aperture that allows for any ingress fluid (air or liquid) to be expelled.

The drill bit 14 has a relatively low profile and is removably attached to the housing 12 with a bit retention means in the form of collar 20 that allows for the drill bit 14 to be threaded on to the housing 12. The trailing end 22 of the drill bit 14 defines a strike face that is described further hereunder.

The drill 10 further comprises a piston member in the form of piston 24, located inside the housing 12. The piston 24 has a generally circular cross-sectional shape and has a trailing end 26 that defines a cavity 28, a leading end 30 and an intermediate portion therebetween that defines a shoulder 32. The leading end 30 is tapered or narrower relative to the trailing end 26. The piston 24 is capable of movement between a first position and a second position at which the leading end 30 impacts the trailing end 22 of the drill bit 14 and is operable by a liquid circuit that delivers liquid to the piston member via inlet 34 and transfers the liquid outside the housing via outlet 36. Conventionally, liquid is exhausted to the cutting face of the drill bit 14 but the present disclosure allows for the exhaust of the liquid to be captured via the outlet 36. Thus, the liquid is contained and exits the housing via outlet 36 so it can be delivered back to the drill via inlet 34. This represents an essentially closed liquid circuit.

Between the inlet 34 and outlet 36 is a flow controller in the form of a valve 38. Liquid, such as water, is delivered to the drill via inlet 34 and differential pressure between the inlet 34 and outlet 36 causes the valve 38 to move between first and second positions that in turn creates a pressure differential that causes the piston 24 to oscillate between its first and second positions and repeatedly strike the trailing end 22 of the drill bit 12: the frequency of the oscillation being a product of the differential pressure. This oscillating movement corresponds to that widely used in water hammer drills and is familiar to those skilled in the art.

When the piston 24 strikes the trailing end 22 of the drill bit 14, it does so in a substantial liquid free environment. The substantial liquid free environment is a result of the action of the sealing member in the form of the O-ring seals 40 that isolate the trailing end 22 of the drill bit 14 from the water. Although some water may pass the O-ring seals 40 any such ingress does not overly compromise the operation of the drill 10.

Figure 2A:
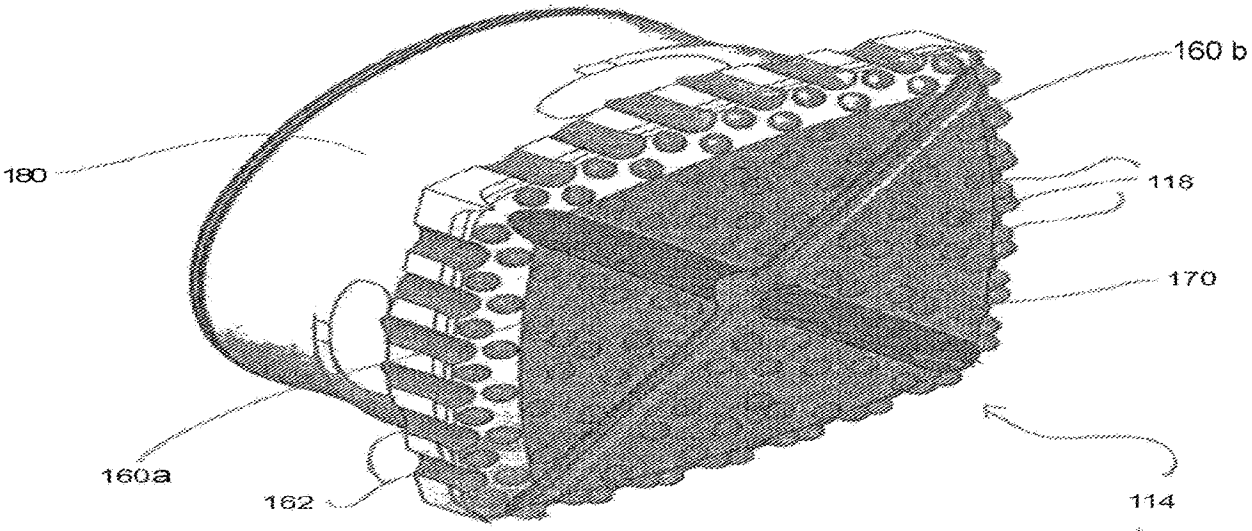
FIG. 2A is a perspective view of a drill bit that can form part of the liquid hammer drill of the present disclosure.
Figure 2B:
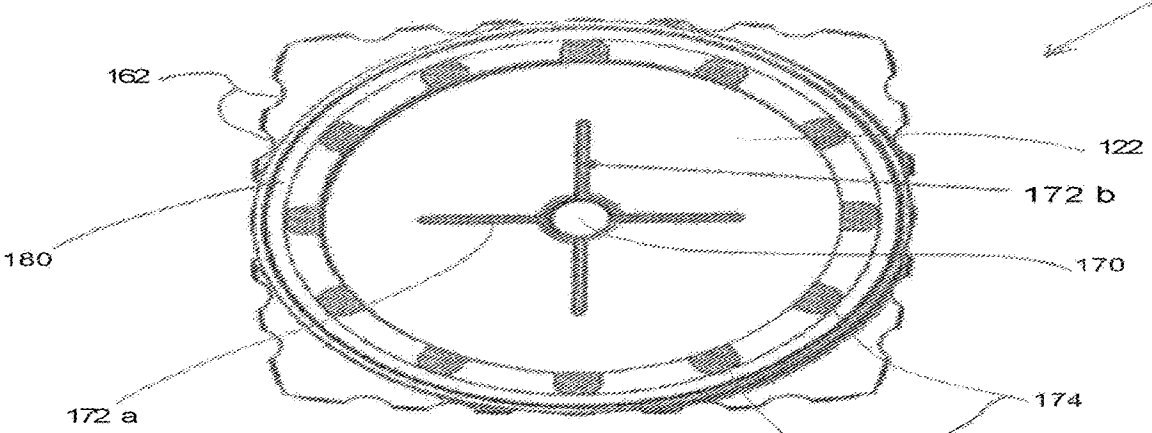
FIG. 2B is an end view of the trailing end of the drill bit in FIG. 2A.

An alternate embodiment of the drill bit that forms part of the drill according to the first aspect of the present disclosure is depicted in FIGS. 2A and 2B and generally indicated by the numeral 114.

The drill bit 114 also has a relatively low profile and a relatively short bit reach of about 70 mm and is adapted to be threaded onto the housing via a threaded engagement on collar 180. The drill bit 114 has a generally square shaped cross section but incorporates an irregular shaped outside edge created by a plurality of cut-outs 162 that form a scalloped edge. The cutting face of the drill bit 114 includes a plurality of buttons 118 of toughened material and a pair of grooves 160*a*, 160*b* that run diagonally across the cutting face and assist with the removal of material away from the cutting face during use. At the centre of the cutting face is an aperture 170 that allows for any fluid (air or liquid) to be expelled from inside the housing of the drill.

The trailing end of the drill bit 114, best shown in FIG. 2B, includes a pair of water relief grooves 172*a*, 172*b* to manage any liquid ingress to the trailing end of the drill bit 114. A locating member in the form of a series of splines 174 located around the periphery of the inside of the collar 180 assist with the location and engagement of the drill bit 114.

Advantages, in use, of the present disclosure including one or more of the performance features in the table below where #1, #2 and #3 represent 3 different embodiments of a drill according to a first aspect of the present disclosure:

| | #1 | #2 | #3 | Units |
|---|---|---|---|---|
| Pressure Differential | 1500 | 2000 | 2500 | Psi |
| Piston Stroke | 30.0 | 30.0 | 30.0 | mm |
| Piston Mass | 255.0 | 255.0 | 255.0 | Kg |
| Bit Mass | 135.0 | 135.0 | 135.0 | Kg |
| Piston/Bit Wt Ratio | 1.89 | 1.89 | 1.89 | |
| Piston Velocity at Impact | 4.20 | 4.83 | 5.39 | m/s |
| Impact Energy | 2251 | 2976 | 3701 | J |
| Bit Velocity after Impact | 7.94 | 9.13 | 10.18 | m/s |
| Impact Energy | 4252 | 5622 | 6991 | J |
| Number Of Strokes/Second | 7.35 | 14.28 | 18.37 | Hz |
| Valve Velocity Up | 6.17 | 7.13 | 7.98 | m/s |
| Valve Velocity Down | 6.28 | 7.24 | 8.09 | m/s |
| Flow rate | 25.4 | 49.4 | 63.6 | (US) GPM |
| | 96.3 | 187.1 | 240.7 | L/min |
| No of buttons in bit | 40 | 40 | 40 | |
| Impact Energy per button | 106 | 141 | 175 | J |

Those skilled in the art will appreciate that the disclosure described herein is susceptible to variations and modifications other than those specifically described. The disclosure includes all such variation and modifications. The disclosure also includes all of the steps and features referred to or indicated in the specification, individually or collectively and any and all combinations or any two or more of the steps or features.

Each document, reference, patent application or patent cited in this text is expressly incorporated herein in their entirety by reference, which means that it should be read and considered by the reader as part of this text. That the document, reference, patent application or patent cited in this text is not repeated in this text is merely for reasons of conciseness.

None of the cited material or the information contained in that material should, however be understood to be common general knowledge.

The present disclosure is not to be limited in scope by any of the specific embodiments described herein. These embodiments are intended for the purpose of exemplification only. Functionally equivalent products and methods are clearly within the scope of the disclosure as described herein.

The disclosure described herein may include one or more range of values (e.g. size etc). A range of values will be understood to include all values within the range, including the values defining the range, and values adjacent to the range which lead to the same or substantially the same outcome as the values immediately adjacent to that value which defines the boundary to the range.

Throughout this specification, unless the context requires otherwise, the word "comprise" or variations such as "comprises" or "comprising", will be understood to imply the inclusion of a stated integer or group of integers but not the exclusion of any other integer or group of integers.

Other definitions for selected terms used herein may be found within the detailed description of the disclosure and apply throughout. Unless otherwise defined, all technical terms used herein have the same meaning as commonly understood to one of ordinary skill in the art to which the disclosure belongs.

The invention claimed is:

1. A liquid hammer drill configured for insertion into a cutter head of a tunnel boring machine comprising:

(a) a housing;

(b) a drill bit disposed at a leading end of the housing the drill bit including a trailing end and a leading end, the leading end defining a cutting portion;

(c) a piston member located inside the housing and having a trailing end and a leading end, the piston member configured to move between a first position and a second position, such that in the second position the leading end of the piston impacts the trailing end of the drill bit; wherein the trailing end of the drill bit defines a strike face for the piston member and the strike face comprises at least one liquid relief groove;

(d) a closed liquid circuit for delivering a liquid to the piston member within the housing to cause the piston member to oscillate between the first and second positions; and a sealing member for isolating the trailing end of the drill bit from the closed liquid circuit, such that the piston member impacts the trailing end of the drill bit in a liquid free environment.

2. The liquid hammer drill according to claim 1, wherein the ratio of the length of the liquid hammer drill to its width is less than 6, 5.5, 5, 4.5, 4, 3.5, 3, 2.5 or 2.

3. The liquid hammer drill according to claim 1, wherein the liquid is any one of water, salt water, petroleum and liquefied gas.

4. The liquid hammer drill according to claim 1, wherein the drill bit has a reach of about 50, 60, 70, 80 or 90 mm.

5. The liquid hammer drill according to claim 1, wherein the drill bit comprises at least one aperture to allow for expulsion of any fluid from inside the housing of the drill.

6. The liquid hammer drill according to claim 1, wherein the piston member comprises a main body that narrows toward the leading end.

7. The liquid hammer drill according to claim 1, the piston further comprising an intermediate portion between the leading end and the trailing end, wherein the intermediate portion of the piston member defines a shoulder.

8. The liquid hammer drill according to claim 1, wherein the body of the piston member defines a cavity therein for receiving the liquid of the closed liquid circuit to move the piston member between the first and second positions.

9. The liquid hammer drill according to claim 1, wherein the piston member has a travel distance between the first and second positions or stroke of about 20, 25, 30 or 35 mm.

10. The liquid hammer drill according to claim 1, wherein the closed liquid circuit does not exhaust liquid via the drill bit.

11. The liquid hammer drill according to preceding claim 1, wherein the closed liquid circuit comprises an inlet into the housing and an outlet from the housing to circulate the liquid of the closed liquid circuit within the housing to drive the piston.

12. The liquid hammer drill according to claim 1, wherein the sealing member is located towards the leading end of the piston member.

13. The liquid hammer drill according to claim 1, wherein the sealing member is located between the leading end of the piston member and the housing.

14. The liquid hammer drill according to claim 1, wherein the sealing member is configured to prevent liquid in the closed liquid circuit from contacting the trailing end of the drill bit, to thereby maintain the liquid free environment.

15. The liquid hammer drill according to claim 1, wherein the drill bit has a square shaped cross-section and the cutting portion located at the leading end of the drill bit is square.

16. The liquid hammer drill according to claim 1, wherein the cutting portion supports a plurality of buttons.

17. The liquid hammer drill according to claim 1, wherein a distance between the trailing end and the leading end of the drill bit is between 50-100 mm.

* * * * *